United States Patent [19]

Okazaki et al.

[11] Patent Number: 5,027,098

[45] Date of Patent: Jun. 25, 1991

[54] SADDLE TYPE DIPOLAR COIL ELIMINATING ONLY SEXTUPOLE COMPONENTS OF MAGNETIC FIELD

[75] Inventors: Toru Okazaki; Shigeki Isojima, both of Osaka, Japan

[73] Assignee: Sumitomo Electric Industries, Ltd., Osaka, Japan

[21] Appl. No.: 565,241

[22] Filed: Aug. 10, 1990

[30] Foreign Application Priority Data

Aug. 22, 1989 [JP] Japan ..... 1-215322

[51] Int. Cl.[5] ..... H01F 5/00

[52] U.S. Cl. ..... 335/213; 313/421

[58] Field of Search ..... 335/210, 213; 313/421, 313/425, 426

[56] References Cited

PUBLICATIONS

The Rutherford M17 Septum Magnet, by Armstrong, 6th International Conference on Magnetic Technology, pp. 820–825, Aug. 29–Sep. 2, 1977.

*Primary Examiner*—George Harris

*Attorney, Agent, or Firm*—Cushman, Darby & Cushman

[57] ABSTRACT

A saddle type dipole coil comprises a pair of elongated ring shaped upper and lower coil layers each having an assembly of coil conductors of series-connected turns. The upper and lower coil layers are opposed each other and disposed on the outer surface of a duct. The end portions of the upper and lower coil layers positioned in a range of a predetermined width are so extended by a predetermined length in the longitudinal direction that the integral value of only sextupole components of a magnetic field is minimized or set nearly zero among the entire multi-pole components of the magnetic field, thereby enabling to make a synchrotron radiation ray generating device with good efficiency of accelerating particles.

7 Claims, 2 Drawing Sheets

SADDLE TYPE DIPOLAR COIL ELIMINATING ONLY SEXTUPOLE COMPONENTS OF MAGNETIC FIELD

BACKGROUND OF THE INVENTION

1. Field of the Invention

The present invention relates to a dipole coil, more particularly to a saddle shaped dipole coil for use in a synchrotron radiation ray generating device (so called a SOR ring) and particle accelerating accumulator or the like.

2. Description of the Prior Art

As shown in FIG. 1, in order to accelerate movement of charged particles or to polarize the progress direction of the particles such as ion or electron projected in a duct 3, there are provided a pair of elongated ring shaped upper and lower coil layers 51 and 52 opposing each other arranged on the upper and lower surfaces of the duct 3 respectively elongated in the longitudinal direction of the duct 3, thereby forming a saddle type dipole coil.

By applying electric current flowing through the upper and lower coils 51 and 52 of the saddle type dipole coil constituted as mentioned above, there occurs a magnetic field with fundamental bipolar components naturally caused by the current flowing through the upper and lower coils 51 and 52 and, in addition, there occurs a magnetic field with quadrapole, sextapole, . . . and 2n-pole components, wherein the number 2n of the poles is determined depending on the positioning relation between the upper and lower coils 51 and 52 in the lateral cross section of the duct 3. Among these multi-pole components of the magnetic field as mentioned above, the bipolar and quadrupole components of the magnetic field are indispensable for forming a particle accelerator. However, the components of sextupole or more than six multi-pole affect an undesired disturbance on the movement of the charged particles running through the duct 3.

Therefore, in the prior art, the conventional saddle type dipole coil is so designed that the integral value of the multi-pole components of the magnetic field is minimized with respect to the entire longitudinal portion of the dipole coil. In addition, the integral value $\int(\Delta B/B)(dl/l)$ of the multi-pole components of the magnetic field must be reduced approximately $10^{-4}$. Herein, B represents the strength of the magnetic field at the center portion thereof, $\Delta B$ denotes a difference between the strength at the center portion thereof and the strength of the magnetic field in the peripheral portion shifted from the center portion, and l denotes a length of the coil in the longitudinal direction thereof.

As described above, in order to minimize the amount of the integral values of the multi-pole components when the upper and lower coils 51 and 52 are arranged on the duct 3 to form a saddle type dipole coil, the degree of freedom for setting the coils 51 and 52 on the duct 3 must be set large to some degree when the upper and lower coils 51 and 52 are designed. Moreover, in order to situate the upper and lower coils 51 and 52 on the predetermined positions of the duct 3 to minimize the integral values of the sextapole or more than six multi-pole components of the magnetic field mentioned above, there must be considered such cases that, it is required to provide a lot of insulation spacers between the coil conductors formed of a set of series-connected turns, and that the number of the laminated layers provided with coil conductors is so increased as to eliminate the multi-pole components in order to minimize the integral values of the multi-pole components. Moreover, a distance "a" between the rising portion and the end portion of the respective coils 51 and 52 must be set in various suitable values as shown in FIG. 1.

As mentioned above, in the conventional saddle type dipole coil, there has been a problem that it is very troublesome and difficult to design and make such a dipole coil.

SUMMARY OF THE INVENTION

In order to solve the problem mentioned above, the present invention has been made and an essential object of the present invention is to provide a saddle type dipole coil which can be designed and made more easily than before.

An aspect of the present invention is in that, upper and lower coil layers with coil conductors arranged therein are so disposed on a duct that, at the end portion of the saddle type dipole coil in the longitudinal direction thereof, only the sextapole components of the magnetic field are eliminated among the entire multi-pole components of the magnetic field generated by the saddle type dipole coil.

According to a feature of the present invention, the saddle type dipole coil is so designed that only the sextapole components are eliminated, while in the conventional saddle type dipole coil, it is so designed as to eliminate the components of the magnetic field corresponding to all of the sextupole or more than six multi-pole.

According to another feature of the present invention, with respect to a portion of the coil conductors situated in a range of a predetermined angle in lateral cross section of the duct among the coil conductors provided on the duct, the integral value of the sextupole components in the saddle type dipole coil can be minimized or set nearly zero merely by suitably setting the length of an extended portion of the straight portion of the coil layer extended in the longitudinal direction of the duct.

The features of the present invention which are believed to be novel are set forth with particularity in the appended claims. The present invention together with further objects and advantages thereof may best be understood with reference to the following detailed description, taken in conjunction with the accompanying drawings.

DETAILED DESCRIPTION OF THE PREFERRED EMBODIMENT

A preferred embodiment of the present invention will be explained with reference to accompanying drawings.

Figure 2:
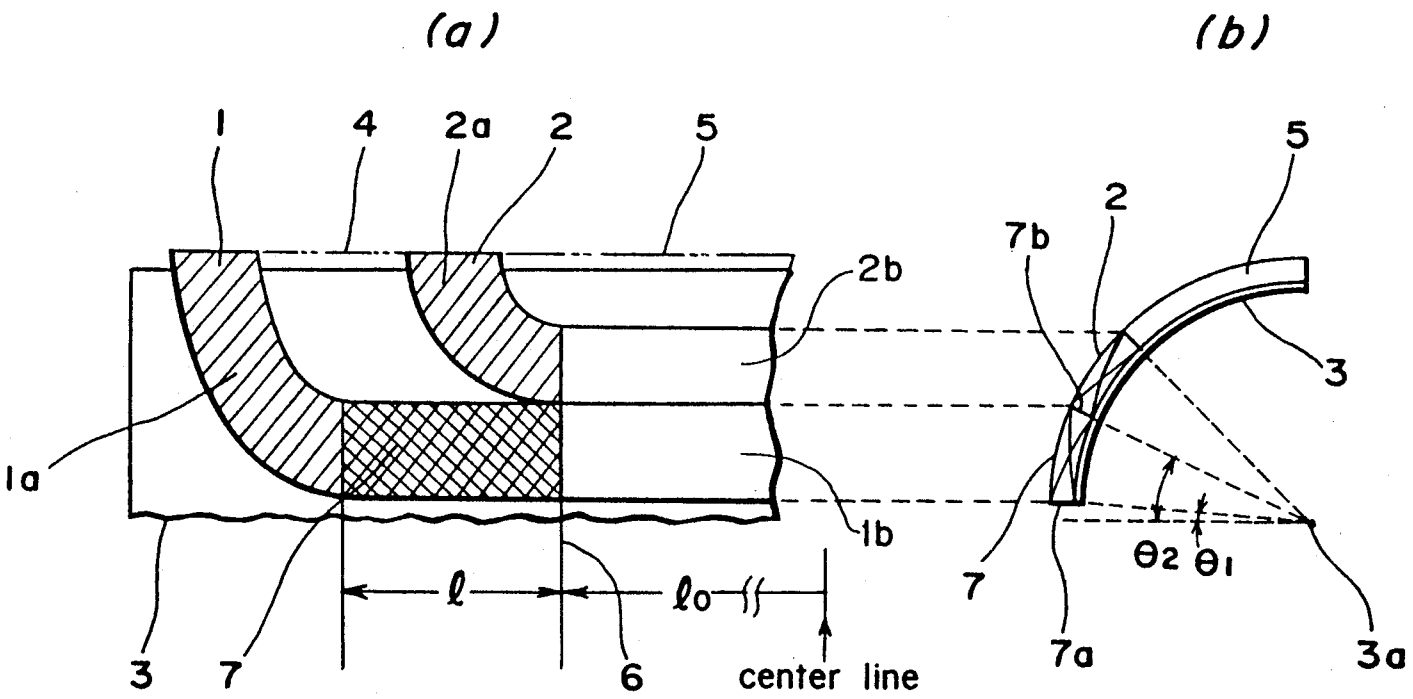

There are provided upper and lower layers each formed of a single laminated layer having an assembly of coil conductors formed of series-connected turns on the outer surface of a duct. The upper and lower coil layers are composed of first and second coil layers 1 and 2 with predetermined width respectively as shown in FIG. 2(*a*).

Figure 1:
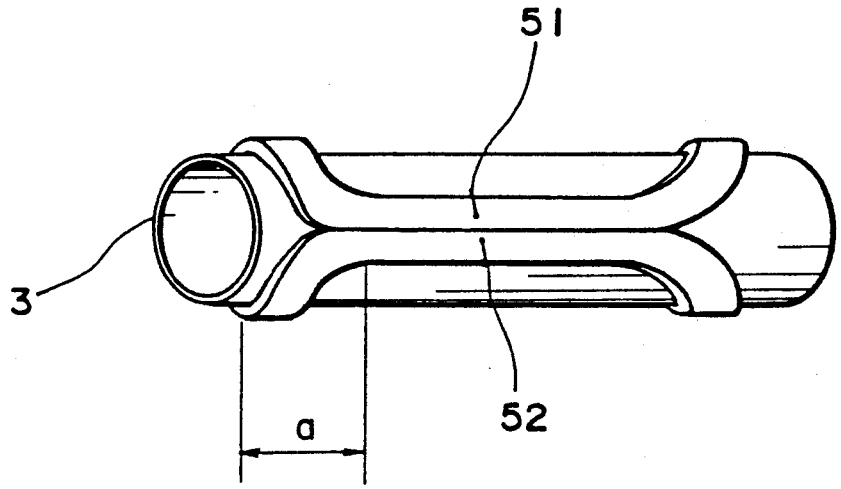
FIG. 1 is a perspective view showing a conventional saddle type dipole coil, FIGS. 2(*a*) and 2(*b*) are a side view and a lateral cross sectional view respectively showing an embodiment of a saddle type dipole coil according to the present invention.
Figure 3:
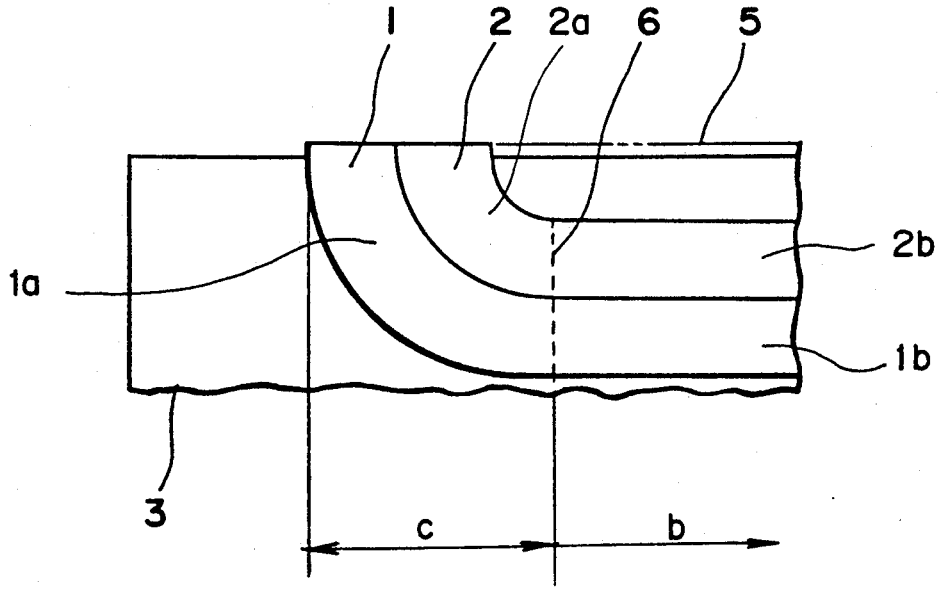
FIG. 3 is a side view for explaining the embodiment shown in FIGS. 2(*a*) and 2(*b*).

FIG. 3 is a side view showing a condition of the upper coil layer provided with coil conductors which is disposed on the duct 3 for forming a saddle type dipole coil, wherein the lower half portion of the duct 3 below the center line in the longitudinal direction of the duct 3 is omitted and the under coil layer is not shown for brevity. There is provided a core 5 of the upper coil layer composed of first and second coil layers 1 and 2 on the outer surface of the duct 3 surrounded by the second coil layer 2, and the core 5 is depicted by a phantom line for convenience.

As shown in FIG. 3, the first and second coil layers 1 and 2 are arranged on the duct 3, wherein the coil layers 1 and 2 comprise straight portions 1*b* and 2*b* corresponding to a length "b" extending straight along the longitudinal center line of the duct 3 and comprise rising semicircular portions la and 2*a* corresponding to a length "c" rising up and curved along the outer peripheral surface of the duct 3. A boundary 6 stands between the straight portion corresponding to "b" and the rising semicircular portion corresponding to "c". With respect to the straight portions 1*b* and 2*b*, the first and second coil layers 1 and 2 can be disposed on the duct 3 in such a manner that the integral value of the sextupole components of the magnetic field is minimized when the saddle type dipole coil is designed and made. On the other hand, with respect to the rising semicircular portions 1*a* and 2*a*, since the rising semicircular shape is indispensable for forming a saddle type dipole coil, the occurrence of the sextupole components of the magnetic field can not be prevented in the rising semicircular portions 1*a* and 2*a*.

Therefore, it is required to situate the first and second coil layers 1 and 2 in such a manner that the magnetic field having sextapole components is so generated by a straight portion of the coil layers 1 and 2 as to eliminate the sextapole components of the magnetic field generated by the rising semicircular portions 1*a* and 2*a* of the coil layers 1 and 2. As shown in FIGS. 2(*a*) and 2(*b*), in the embodiment of the saddle type dipole coil according to the present invention, in order to eliminate the sextapole components of the magnetic field generated by the rising semicircular portions 1*a* 2*a* of the coil layers 1 and 2 with good efficiency, only the straight portion 1*b* with length of $2l_o$ of the coil layer 1 extending along the horizontal plane including the center axis of the duct 3 is extended straight at the end portion thereof in the longitudinal direction of the duct 3 by a length of l as shown in FIG. 2(*a*). In addition, there is provided a spacer 4 made of appropriate insulation material in the space between the rising portion 1*a* of the coil layer 1 and the rising portion 2*a* of the coil layer 2 on the outer surface of the duct 3 corresponding to the extended portion 7 of l long depicted by a meshed portion.

The strength $q_3$ of the magnetic field corresponding to the sextupole components generated by the extended portion 7 shown by a meshed portion is calculated by an expression as follows:

$$q_3=(ANl/9)(\sin 3\theta_2-\sin 3\theta_1)$$

Herein, A and N are constant values determined by the shape and size of the coil layer 1 and, $\theta_1$ denotes an angle defined between a straight line passing through the bottom surface 7*a* of the extended portion 7 and through the center point 3*a* of the duct 3 and the horizontal plane including the center point 3*a* of the duct 3, and $\theta_2$ denotes an angle defined between a straight line passing through the top surface 7*b* of the extended portion 7 and through the center point 3*a* of the duct 3 and the horizontal plane including the center point 3*a* of the duct 3. The strength $q_3$ of the sextupole components of the magnetic field becomes maximum when the angle $\theta_2$ is set 30° and the angle $\theta_1$ is set 0° .

Accordingly, the extended portion 7 of the first coil layer 1 is so formed that the angles $\theta_1$ and $\theta_2$ are set 0° and 30° respectively. Moreover, the bottom and top surfaces of the straight portion 1*b* of the coil layer 1 can be also defined by the above mentioned angles $\theta_1$ and $\theta_2$.

In addition, the angles $\theta_1$ of 0° and $\theta_2$ of 30° are aimed values and some modification thereof may occur for designing the dipole coil.

By defining the angles $\theta_1$ and $\theta_2$ to be predetermined values with respect to the extended portion 7 of the first coil layer 1 as mentioned above, the sextupole components of the magnetic field generated by the extended portion 7 can be made maximum for offsetting the sextupole components of the magnetic field generated by the rising semicircular portions 1*a* and 2*a* of the first and second coil layers 1 and 2.

Accordingly, the length l of the extended portion 7 of the first coil layer 1 may be appropriately adjusted in such a manner that the extended portion 7 generates the magnetic field with sextupole components for offsetting other sextupole components generated by the rising portions 1*a* and 2*a* of the coil layers 1 and 2, so that it becomes possible to design the dipole coil more easily than in the conventional method of forming a conventional dipole coil in which all of the multi-pole components of the magnetic field are eliminated. In addition, as described above, it is confirmed that the synchrotron radiation ray generating device (so called a SOR ring) can be formed with good performance of accelerating particles by employing the saddle type dipole coil eliminating only the sextapole components among the entire multi-pole components.

Moreover, in this embodiment described above, although there is laminated a single coil layer having an assembly of coil conductors of series-connected turns on the outer surface of the duct in the diameter direction thereof, there can be also laminated two or more than two layers with an assembly of coil conductors if it is difficult to eliminate the sextupole components of the magnetic field generated by the rising portions 1*a* and 2*a* of the first and second coil layers 1 and 2 with a single layer of coil conductors.

As described above, according to the present invention, the components of the magnetic field to be eliminated are limited to the sextupole components among the entire multi-pole components of the magnetic field, resulting in facilitation of designing and making the saddle type dipole coil .

In the saddle type dipole coil according to the present invention, the integral value of only sextupole components of the magnetic field is minimized, thereby enabling to make a synchrotron radiation ray generating device with good efficiency of accelerating particles, which are confirmed in a simulation test using a computer.

The invention being thus described, it will be obvious that the same may be varied in many ways. Such variations are to be regarded as a departure from the spirit and scope of the invention, and such modifications, as would be obvious to one skilled in the art, are intended to be included within the scope of the claims.

What is claimed is:

1. A saddle type dipole coil comprising:

particle conducting means made of insulation material with generally cylindrical shape for accelerating charged particles passing therein;

a pair of elongated ring shaped upper and lower coil layers composed of one or more layers laminated in the diameter direction of said particle conducting means, each having an assembly of coil conductors of series-connected turns, said upper and lower coil layers opposing each other disposed on the outer surface of said particle conducting means and respectively elongated in the longitudinal direction thereof, and offset means for eliminating only sextapole components among entire multi-pole components of a magnetic field generated by the end portion in the longitudinal direction of said saddle type dipole coil.

2. The dipole coil as defined in claim 1, wherein each of said upper and lower coil layers comprises a straight portion with a predetermined length extending along the longitudinal center line of said conducting means and a rising semicircular portion at the end portion thereof rising up and curved along the outer peripheral surface of said conducting means.

3. The dipole coil as defined in claim 1, wherein said upper and lower coil layers are provided in a range of 0° to 180° and of 180° to 360° respectively defined on the basis of the center line in lateral cross section of said particle conducting means, and the end portions of said upper and lower coil layers disposed in a range of a predetermined angle defined on the basis of the center line passing between 0° position and 180° position in lateral cross section of said particle conducting means are extended straight by a predetermined length in the longitudinal direction of said conducting means.

4. The dipole coil as defined in claim 2, wherein the length of each said extended portion of the upper and lower coil layers is appropriately adjusted in such a manner that the extended portion generates sextupole components of the magnetic field for offsetting other sextupole components of the magnetic field generated by the rising semicircular portions of said upper and lower coil layers.

5. The dipole coil as defined in claim 3, wherein said predetermined angle is defined to be 30° for obtaining the maximum strength of the sextapole components of the magnetic field generated by said extended portion.

6. The dipole coil as defined in claim 1, wherein said upper and lower coil layers are formed of two or more than two laminated layers each having an assembly of coil conductors of series-connected turns.

7. The dipole coil as defined in claim 1, wherein each of said upper and lower coil layers is composed of first and second coil layers (1) and (2) with predetermined width respectively.

* * * * *